United States Patent [19]

Stratton

[11] Patent Number: 4,689,961

[45] Date of Patent: Sep. 1, 1987

[54] COMBUSTION EQUIPMENT

[75] Inventor: John F. Stratton, Accrington, England

[73] Assignee: Lucas Industries public limited company, Birmingham, England

[21] Appl. No.: 910,783

[22] Filed: Sep. 23, 1986

Related U.S. Application Data

[63] Continuation of Ser. No. 704,281, Feb. 22, 1985, abandoned.

[30] Foreign Application Priority Data

Feb. 29, 1984 [GB] United Kingdom ..... 8405271

[51] Int. Cl.[4] ..... F02C 1/00; B05B 7/10

[52] U.S. Cl. ..... 60/748; 60/746; 239/400; 239/403

[58] Field of Search ..... 60/734, 737, 738, 740, 60/746, 747, 748; 239/400, 403

[56] References Cited

U.S. PATENT DOCUMENTS

| | | | |
|---|---|---|---|
| 2,560,207 | 7/1951 | Berggren et al. | 60/748 |
| 2,958,195 | 11/1960 | Dooley | 60/748 |
| 3,605,405 | 9/1971 | Du Bell et al. | 60/748 |
| 3,703,259 | 11/1972 | Sturgess et al. | 239/400 |
| 3,831,854 | 8/1974 | Suto et al. | 60/748 |
| 3,853,273 | 12/1974 | Bahr et al. | 60/748 |
| 3,927,835 | 12/1975 | Genrard | 60/748 |
| 3,946,552 | 3/1976 | Weinstein et al. | 60/748 |
| 4,216,652 | 8/1980 | Herman et al. | 60/748 |
| 4,426,841 | 1/1984 | Cornelius et al. | 60/748 |
| 4,584,834 | 4/1986 | Koshoffer et al. | 60/748 |

FOREIGN PATENT DOCUMENTS

| | | |
|---|---|---|
| 2108013 | 5/1972 | France . |
| 537519 | 7/1973 | Switzerland . |
| 682778 | 11/1952 | United Kingdom . |
| 1184683 | 3/1970 | United Kingdom . |
| 1594463 | 7/1981 | United Kingdom . |
| 2123137 | 1/1984 | United Kingdom . |

OTHER PUBLICATIONS

"Zeitschrift fur Flugwissenchaften", vol. 18, No. 8, Aug. 1970, pp. 286–290.

*Primary Examiner*—Louis J. Casaregola
*Assistant Examiner*—Timothy S. Thorpe

[57] ABSTRACT

Combustion equipment e.g. for a gas turbine engine comprises an annular flame tube having air inlet openings fitted with respective air swirler devices surrounding respective fuel atomizers. Flare portions define an annular flare in which the atomizers and swirler devices are provided. To reduce the formation of a liquid fuel film on the wall of the flame tube, dividing means in the form of a smaller flare is provided for dividing the air flow through each of the swirler devices so as to create a fuel-free film of air adjacent the annular flare.

6 Claims, 6 Drawing Figures

COMBUSTION EQUIPMENT

This application is a continuation, of application Ser. No. 704,281, filed Feb. 22, 1985, now abandoned.

This invention relates to combustion equipment and is particularly concerned with combustion equipment of the type incorporating a flame tube. The invention is particularly, though not exclusively, concerned with combustion equipment for gas tubine engines.

In combustion equipment having a flame tube, liquid fuel is sprayed into the flame tube from one or more fuel injectors. In the case of a tubular flame tube, only one fuel injector may be provided. However, in the case of an annular flame tube, a series of fuel injectors are usually provided in spaced apart relationship on a pitch circle around the axis of the annular flame tube. It is known to arrange for a divergent discharge pattern from the or each fuel injector and to provide a frustoconical, annular flare through which the injector discharges. It is also known to provide a series of air swirler blades around the injector and to provide for secondary air admission through secondary air inlets arranged in the wall of the flame tube downstream of the flare. These secondary air inlets are arranged to discharge jets of air inwardly of the flame tube towards the centre line of the fuel injector. The swirler air flow discharges outwards adjacent to the flare. Thus, at least part of the secondary air through the secondary air inlets is caused to flow first in the upstream direction towards the fuel injector, then outwardly adjacent to the flare and finally downstream along the wall of the flame tube, thus creating a toroidal recirculation of air flow. This recirculation ensures that the swirler air flow passes along the flare.

In the case where fuel is injected in a conical spray discharge pattern inside this toroidal air recirculation pattern, the fine fuel particles of the spray are induced into the air swirler flow and could be deposited on the inner surface of the flare. Depending upon the operating conditions they may form a liquid film on the flare, or they may be decomposed to form carbon, or they may be evaporated to form a combustible mixture with the air flow passing along the flare. In the last case (which is typical of Full Load operation of the gas turbine engine) a rich film is created adjacent to the inner surface of the flare which passes outwardly towards the wall of the flame tube and in the process may be partially combusted. However, when this film reaches a location adjacent to secondary cooling air inlets, quenching of the combustion process can occur to produce carbon or unburnt hydrocarbons which results in significant exhaust smoke and combustion inefficiency.

It is an object of one aspect of the present invention to obviate or mitigate this disadvantage.

According to the present invention, there is provided combustion equipment comprising a flame tube, a fuel injector disposed at an inlet end of the flame tube, an air swirler device surrounding the fuel injector, a flare having a passage in which the injector and air swirler device are disposed so that, in use, liquid fuel from the injector and swirling air from the air swirler are discharged into a combustion zone of the flame tube, wherein means are provided for dividing the swirling air flow into an outer annular portion and inner annular portion.

With this arrangement, the flow dividing means creates a film of air adjacent to the flare which is free of fuel, and the inner portion of the swirling air will inevitably carry the finer fuel particles which would otherwise be deposited immediately into the flare. Thus, wetting of the flare is delayed.

Most advantageously, said flow dividing means comprises a smaller flare which is disposed internally of the first-mentioned flare and which extends only a sufficient distance over the surface of the latter from said passage to ensure effective division of the swirling air into the aforementioned inner and outer annular portions.

The invention is particulary applicable to combustion equipment of the type in which the air swirler device includes a plurality of inclined, fixed air swirler blades. With such an arrangement, it is convenient for an upstream end of the smaller flare to be mounted on the blades at a downstream end thereof. Conveniently, this can be effected by providing a recess in the downstream end of each swirler blade, and mounting the smaller flare in the recesses.

The flow dividing means is preferably arranged so that the amount of air flowing through the outer annular portion in use, represents 3 to 5% of the total air flow through the flame tube. Although the provision of the flow dividing means delays fuel deposition on the flare, it is possible that mixing of the inner and outer swirling air portions will occur to give some deposition of fuel on the flare with the attendant production of carbon and unburnt hydrocarbons. To prevent, or reduce this in combustion equipment where the aforementioned flow dividing means is not provided, the first mentioned flare is provided with a series of air inlet openings around the passage in which the air swirler and injector are located. In use, jets of air are provided, which contain the toroidal vortex to recirculate within a smaller diameter than that fixed by the flame tube walls. Thus, the fuel rich layer adjacent to the inner surface of the flare is turned into the recirculation by the jets which themselves add more air to promote good combustion and prevent the partly combusted mixture from contacting the wall cooling air. Consequently smoke production is eliminated and combustion efficiency raised under adverse conditions by avoiding quenching of combustion products.

Preferably, the air inlet openings in the flare are arranged to provide the aforesaid jets of air surrounded by lower pressure air which is swept, in use, along the inner wall of the flare to provide additional cooling.

Whilst the toroidal vortex is confined to a smaller diameter, it is to be appreciated that the region outside the recirculation is a combustion zone but predominantly of gaseous phase combustibles.

The ratio of air in the jets to lower pressure air is preferably 2:1 to 3:1.

In one embodiment, the high pressure jets and lower pressure air are provided by a member having apertures through which the high pressure air is constrained to pass before it passes through the openings in the flare, the apertures in said member being aligned with the openings in the flare and being of smaller area, said member also preferably having smaller holes therethrough which are not aligned with the apertures in the flare and which provide said lower pressure air.

In another embodiment, the high pressure air jets and lower pressure air are provided by sleeves which terminate in said openings and through which the high pressure air is supplied to said openings in the flare to produce the jets, there being a clearance around each of said sleeves in the respective openings so as to permit passage of the lower pressure air through said openings.

In the case where the air swirler device comprises a plurality of inclined air swirler blades, the openings in the flare will be disposed opposite the discharge from the gap between each swirler blade.

Conveniently, in the first mentioned embodiment, the apertures are made in the form of slots which are inclined in the opposite sense to the swirler blades.

Combustion equipment having an annular flame tube has been previously proposed in which an annular flare is composed of a plurality of flare segments which are spaced apart around the annulus, each segment having a passage therethrough for receiving a fuel injector. In such previously proposed combustion equipment, each flare segment has inner and outer peripheral edges which are bent so as to extend in the downstream direction relative to the general flow of gases along the flame tube and has substantially radially extending side edges which are similarly bent in the downstream direction. The side edges of adjacent flare segments are spaced a small distance apart. The flare segments of such combustion equipment are relatively rigid and overcome the problems of stress formations in a unitary flare as a result of temperature variations around the flame tube. However, it has now been found that such a construction limits cross-flow of fuel and air from one segment to another, with the result that particularly during the starting or "light-up" phase of operation of the combustion equipment, ignition of the gases in one segment by the flame from those in an adjacent segment is hindered.

An object of a further aspect of the present invention is to obviate or mitigate this problem.

According to this further aspect of the present invention, the side edges of each flare segment are directed in the upstream direction, rather than in the downstream direction. Thus, the side edges of each flare segment are directed in the opposite direction to that in which the inner and outer peripheral edges of each flare segment are directed. Such a construction ensures that the rigidity of each flare segment is maintained and at the same time removes the barrier to cross-flow from one flare segment to the next.

IN THE ACCOMPANYING DRAWINGS

Figure 1:
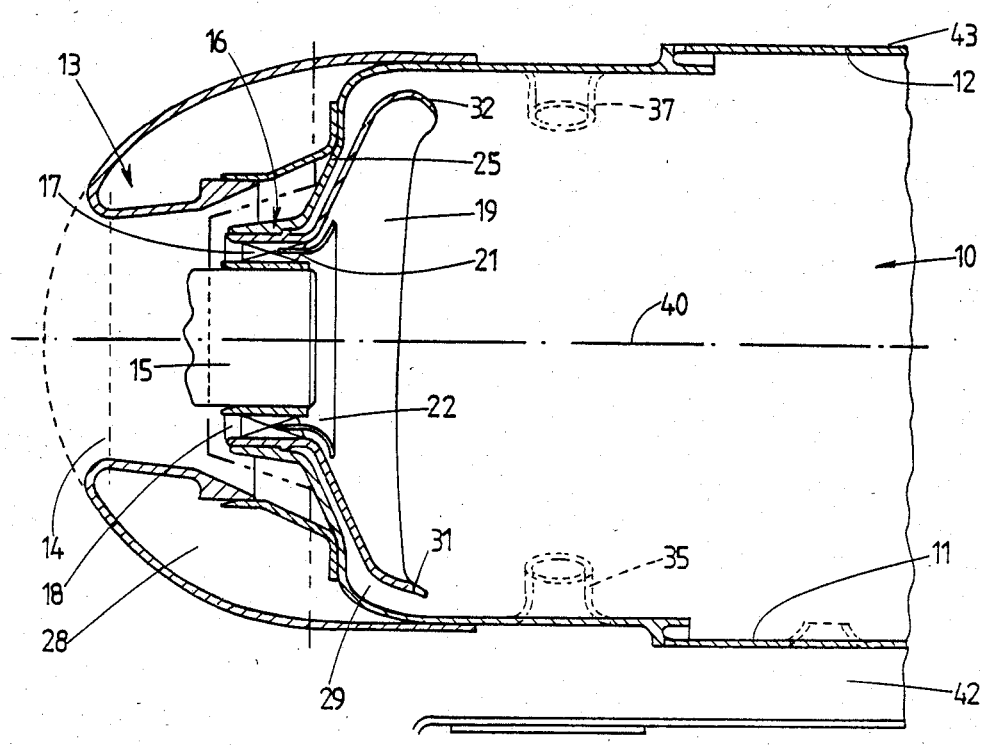
FIG. 1 is an axial section through part of one embodiment of combustion equipment according to the present invention.
Figure 3:
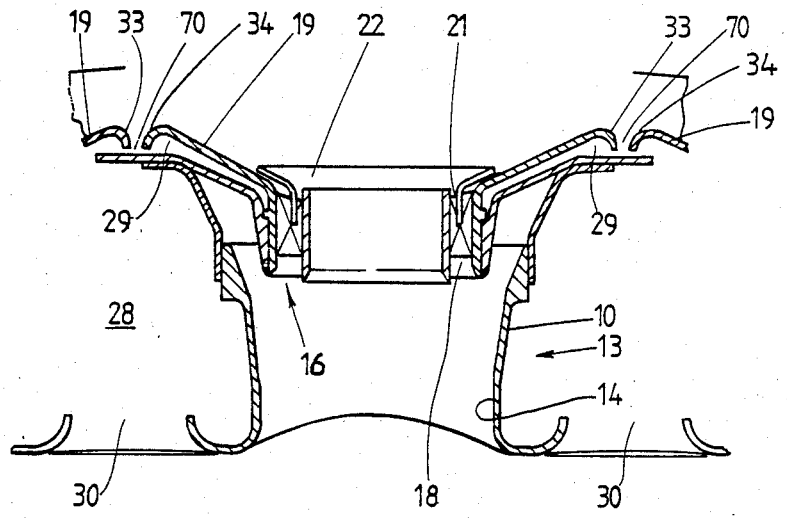
FIG. 3 is a section on the line 3—3 of FIG. 2.
Figure 2:
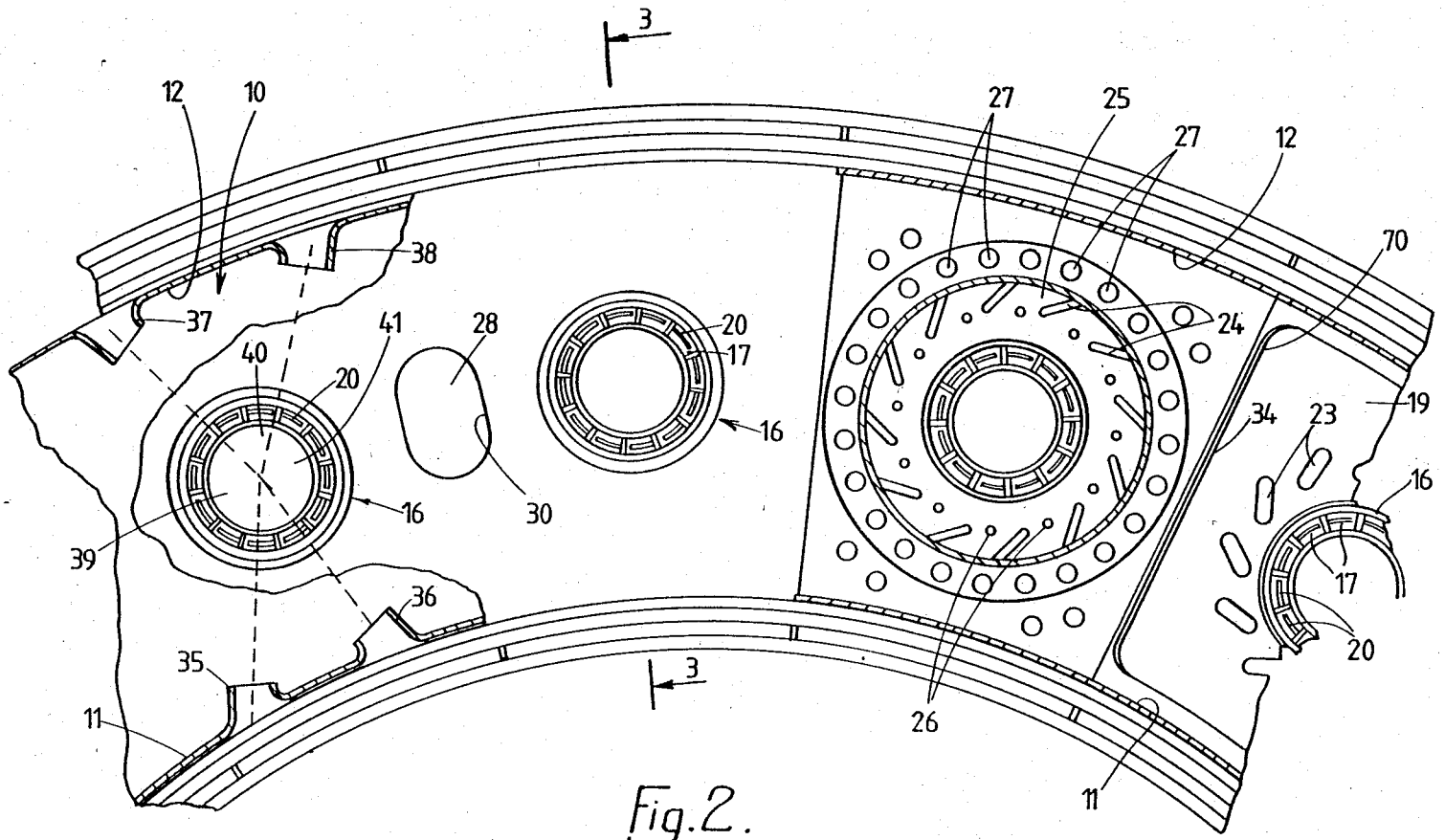
FIG. 2 is a part cut-away cross-section of part of the equipment of FIG. 1.

Referring now to FIGS. 1 to 3 of the drawings, the combustion equipment illustrated therein is for a gas turbine engine and includes a fabricated, annular flame tube 10 having an inner peripheral wall 11 and an outer peripheral wall 12. At an inlet or upstream end 13 of the flame tube, there is provided a plurality of inlet openings 14 which are equi-angularly spaced around the annular flame tube 10. Each inlet opening 14 receives a respective fuel atomizer 15 which is arranged to discharge liquid fuel in a conical spray pattern, the cone angle of which is about 90°. An air swirler device 16 surrounds a downstream end portion of the fuel atomizer 15 and has a multiplicity of blades 17 which are inclined so as to impart a swirl to air passing between the blades 17. The swirl is in the counterclockwise direction when viewed in the direction of flow of air to the air swirler device 16. Each assembly of fuel atomizer 15 and air swirler device 16 is disposed in a central passage 18 in a respective flare segment or portion 19. The flare portions 19 together define an annular flare which extends completely around the flame tube 10 although it is radially split between the portions 19 to limit the effects of stresses therein resulting from temperature variations around the flame tube. Each inclined blade 17 of the air swirler device 16 has a slot 20 machined into its downstream end. The slots 20 of the blades 17 in each air swirler device receive a sleeve 21 of a further, frustoconically divergent flare 22 which is smaller than the main flare defined by portions 19. As can be seen from FIGS. 1 and 3, each flare 22 is disposed wholly within the respective flare portion 19 and only extends for about 0.5 cm along the divergent part of the flare portion 19. The further flare 22 acts as a means for dividing air passing through the air swirler device 16 into an outer annular portion and an inner annular portion. The effect of these portions will be described hereinafter. In this embodiment the amount of air in the outer annular portion represents 4% of the total air flow through the flame tube.

In a portion thereof which is downstream of the further flare 22 relative to the general direction of flow over its surface, the flare portion 19 has a ring of inclined slots 23 therethrough (see particularly FIG. 2). Each slot 23 is associated with a respective one of the passages defined between adjacent blades 17 in the air swirler device 16. Each slot 23 is so disposed and inclined that it extends transversely relative the path of movement of the air passing over the surface of the flare portion 19 from the passage between a respective pair of adjacent blades 17. The spacing between adjacent slots 23 in each ring is such that although they do not actually overlap in the circumferential direction, they present, in effect, an uninterrupted ring to the air in view of the direction and angle of the swirl imparted to the air by the blades 17.

A corresponding number of slots 24 are provided in a wall 25 in the flame tube 10. Each slot 24 is aligned with and disposed behind a respective one of the slots 23. However, each slot 24 has a smaller cross sectional area than its associated slot 23. The wall 25 is provided with holes 26 therein. The holes 26 are arranged on a pitch circle disposed just inwardly of the slots 24. These holes 26 are of about the same diameter as the width of the slots 24. Each hole 26 is located about midway between a respective pair of adjacent slots 24. Larger diameter holes 27 are provided in the wall 25 and are arranged on a pitch circle around the ring of slots 24. The holes 27 serve to provide communication between a plenum chamber 28 and an area 29 behind the flare portion 19. The plenum chamber 28 is supplied with air via openings 30 (see FIGS. 2 and 3).

As can be seen particularly from FIGS. 1 and 3, each flare portion 19 has inner and outer peripheral edges 31 and 32 respectively, which are directed in a downstream direction relative to the general direction of flow of air through the flame tube. However, each flare portion 19 has radial side edges 33 and 34 which are directed in the opposite direction, i.e. in the upstream direction, so as to face the area 29. As cah be seen particularly from FIG. 3, a gap 70 is provided between the side edges 33 and 34 of adjacent flare portions 19.

The inner peripheral wall 11 of the flame tube 10 is provided with a pair of secondary air inlet nozzles 35 and 36 whilst the outer peripheral wall 12 of the flame tube 10 is provided with a pair of secondary air inlet nozzles 37 and 38.

Figure 4:
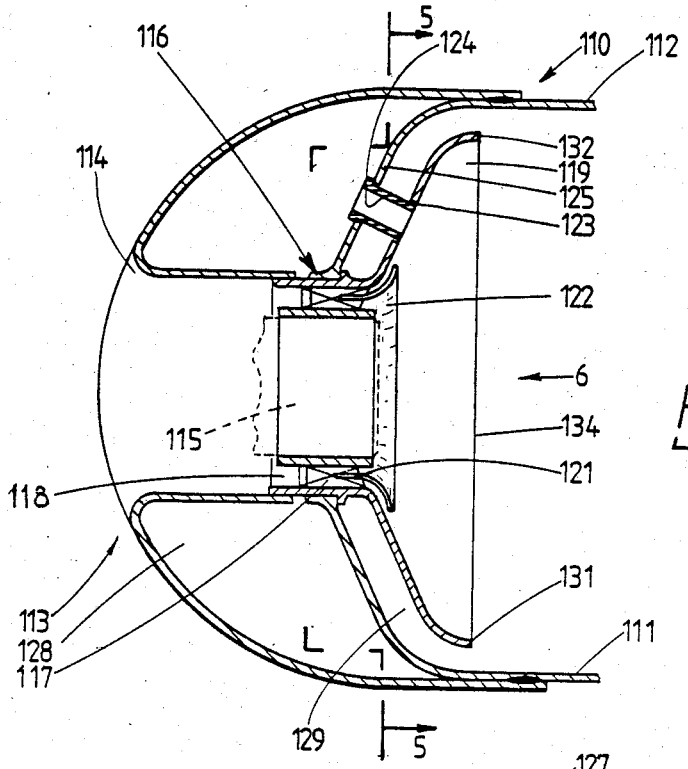
FIG. 4 is an axial section through part of another embodiment of combustion equipment according to the present invention.
Figure 5:
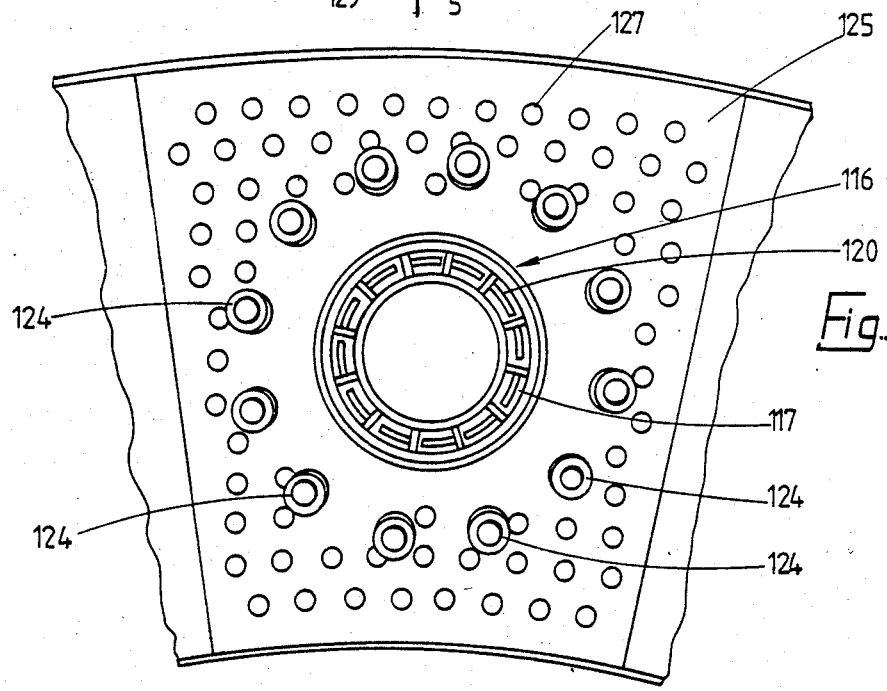
FIG. 5 is a section on the line 5—5 of FIG. 4.
Figure 6:
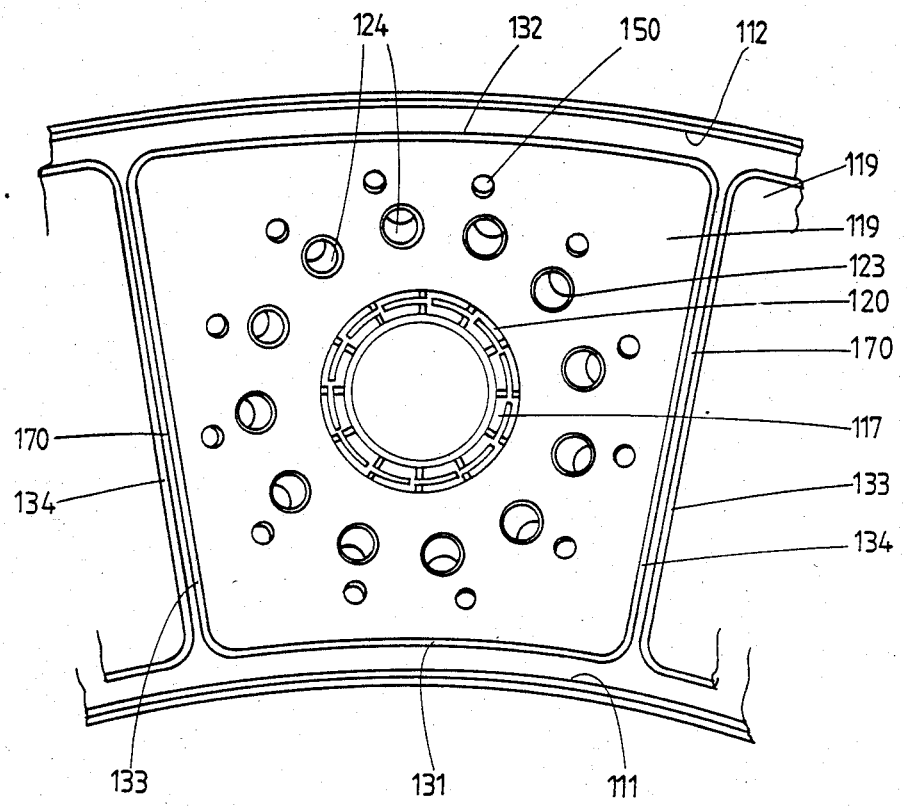
FIG. 6 is a view in the direction of arrow 6 in FIG. 4.

In the second embodiment of combustion equipment according to the present invention, as illustrated in FIGS. 4 to 6, similar parts to those of FIGS. 1 to 3 are accorded the same number but prefixed by the numeral 1. The major differences between the embodiment of FIGS. 4 to 6 and that of FIGS. 1 to 3 will now be described. Instead of being provided with slots 23, each flare portion 119 is provided with a ring of circular holes 123 which, like the slots 23, are disposed in the path of movement of air over the surface of the flare portion 119 from the associated passages between adjacent blades 117 in air swirler device 116. Wall 125 in flame tube 110 is fitted with sleeves 124 which bridge area 129 at the back of flare portion 119. The sleeves 124 engage in the respective holes 123 with clearance in that an annular space is defined between the edge of each hole 123 and the outer surface of the respective sleeve 124. The wall 125 is provided with a multiplicity of holes 127 all over its surface except radially inwardly of the sleeves 124. The holes 127 provide communication between the plenum chamber 128 and the area 129. Each flare portion 119 is also provided with a series of equi-spaced holes 150 which are of smaller diameter than the holes 123 and are disposed on a pitch circle outwardly of the holes 123.

In this embodiment, each flare portion 119 has radial side edges 113 and 114 which do not have the feature of being bent rearwardly or in the upstream direction, but are bent forwardly or in the downstream direction, i.e. in the same direction as that in which inner and outer edges 131 and 132 of the flare portion 119 are bent.

The modus operandi of the embodiment of FIGS. 1 to 3 will now be described.

A toroidal vortex recirculation air flow pattern is established in the flame tube as a result of air entering the flame tube through each air swirler 16 and the associated secondary air inlet nozzles 35 to 38 as described previously. Each further flare 22 splits the flow of swirling air, as described above, into inner and outer annular swirling air portions. Each outer swirling air portion passes over the inner surface of the respective flare 19 whilst the inner swirling air portion entrains the finer fuel droplets. This arrangement prevents fuel from being immediately deposited on the inner surface of the flare 19. At the same time, the remainder of the air entering each inlet opening 14 passes through the slots 24 and holes 26 in the wall 25. The air passing through the slots 24 is projected as jets straight through the slots 23 in the flare portion 19 because of the mutual alignment of the sets of slots 23 and 24. The air from the slots 24 provides a major portion of the total air flow through the slots 23.

The effect of this is to constrain the toroidal vortex to recirculate within a smaller diameter than that fixed by the flame tube walls. Additionally, the jets of air themselves add more air to promote good combustion and prevent the partly combusted mixture from contacting the wall cooling air, thus eliminating smoke production and raising efficiency under adverse operating conditions by avoiding quenching of the combustion products. Because the slots 23 have a greater area than the slots 24, a minor portion of air at lower pressure than the air in the jets is drawn through the slots 23 from the area 29.

The area 29 is fed with air not only from opening 14, via the holes 26 but also from the plenum chamber 28 via the holes 27. The air which is drawn through the slots 23 surrounds the air from slots 24 and flows over the surface of the flare 19, thus further cooling the flare portion 19.

The majority of the air entering area 29 via the holes 27 either passes the inner and outer edges 31 and 32 of the flare portion 19 and so cools the inner and outer walls 11 and 12 of the flame tube 10 as well as providing further air for combustion, or passes through the gaps 70 between adjacent flare portions 19.

Because of the arrangement of the radial side edges 33 and 34 of each flare portion 19, there is a cross flow of fuel and air from one flare portion 19 to the next to ensure efficient combustion. This is particularly advantageous during the starting or "light-up" phase of the combustion equipment. It is found that a more effective combustion occurs with the flare arrangement of FIGS. 1 to 3 than with that of FIGS. 4 to 6 where the downstream projecting radial side edges 133 and 134 hinder flow of fuel and air from one flare portion 119 to the next.

The splitter 122 in the embodiment of FIGS. 4 to 6 operates in a similar way to that described with reference to FIGS. 1 to 3. In the embodiment of FIGS. 4 to 6, however, all the air which enters opening 114 is constrained to pass through the air swirler 116. Also, all of the air entering the flame tube via the holes 123 in each flare portion 119 comes from the plenum chamber 128. The majority of air entering via holes 123 is supplied through the sleeves 114. However, some of the air from area 129 is drawn through the holes 123 externally of the sleeves 124 because of the clearance therebetween. This air which is drawn through the holes 123 from area 129 tends to follow the surface of the portion 119 and so the effect produced by the sleeves 124 and holes 123 is similar to that produced by the slots 23 and 24 in the embodiment of FIGS. 1 to 3.

I claim:

1. Combustion equipment comprising a flame tube having walls defining a combustion zone therein, flame tube wall means in which is defined an air inlet to be at one end of said flame tube; an outer flare segment mounted in said flame tube adajacent said inlet, said outer flare segment having a passage through said outer flare segment communicating with said air inlet and with said combustion zone; a fuel injector disposed in said passage and having a fuel outlet discharging into said combustion zone; an air swirler device disposed in said passage and surrounding said fuel injector, said air swirler device including a plurality of spaced blades which are shaped and positioned to cause air flowing from said air inlet and passing through said passage and between said blades and into said combustion zone to move in a swirling motion about the flow direction axis, adjacent edges of adjacent blades defining gaps through which said air flows; an inner flare mounted on said air swirler device, said inner flare having a downstream portion which expands radially outwardly of said passage to direct a first amount of the flowing air against an inner surface of said outer flare segment and a second amount of the flowing air along a path spaced from the inner surface of said outer flare segment; a plurality of elongate slots defined in said outer flare segment to be located peripherally outside of said inner flare, said slots being positioned to form an annulus which is concentric with said passage and providing further communication between said air inlet and said combustion zone, each said slot being locating adjacent to one of said gaps, each slot having a radially outer end and a radially inner end with a longitudinal axis extending between said ends, said slots being oriented so that said longitudinal axis is located along a secant of said annulus and is inclined so that the direction of extent of said slot longitudinal axis from said outer slot end to said inner slot end is opposite to the direction of said air swirling motion, means for providing air to said slots so that air passing through said slots flows in a direction different from said swirling direction and flows on a path which surrounds said swirling air to constrain and confine flow of fuel from said fuel injector and swirling air from said air swirler device and prevent such fuel and swirling air from moving radially outward beyond said annulus.

2. Combustion equipment as claimed in claim 1, wherein said flame tube wall has a plurality of slots located in a second annulus, each of said flame tube wall slots being aligned in the direction of flow into said outer flare segment passage with a respective one of said slots in said outer flare segment but having a smaller area.

3. Combustion equipment as claimed in claim 2, wherein said flame tube wall has a plurality of small apertures therethrough which are not aligned in the direction of flow into said outer flare segment passage with slots in said outer flare segment.

4. Combustion equipment as claimed in claim 1, wherein an upstream end of said inner flare is mounted on said air swirler blades.

5. Combustion equipment as claimed in claim 4, wherein a recess is provided in a downstream end of each swirler blade, and said inner flare is mounted in said recesses.

6. Combustion equipment as claimed in claim 1, wherein said inner flare is positioned relative to said injector to be spaced from the inner surface of said outer flare segment to define a gap sized so that the first amount of air represents 3 to 5 of the total flow through said flame tube.

* * * * *